US006675890B2

(12) United States Patent
Pietrobelli et al.

(10) Patent No.: US 6,675,890 B2
(45) Date of Patent: Jan. 13, 2004

(54) PACKING DEVICE FOR OIL WELLS

(76) Inventors: Alejandro Pietrobelli, Ctro Cial. Tacariua, Ave Intercommunal, Tia Juana, Edo Zulia (VE); Fausto Pietrobelli, Ctro Cial. Tacariua, Ave Intercommunal, Tia Juana, Edo Zulia (VE)

( * ) Notice: Subject to any disclaimer, the term of this patent is extended or adjusted under 35 U.S.C. 154(b) by 14 days.

(21) Appl. No.: 10/100,571

(22) Filed: Mar. 15, 2002

(65) Prior Publication Data

US 2003/0173074 A1 Sep. 18, 2003

(51) Int. Cl.[7] ..... E21B 23/06
(52) U.S. Cl. ..... 166/124; 166/182; 166/196
(58) Field of Search ..... 166/124, 139, 166/182, 181, 196

(56) References Cited

U.S. PATENT DOCUMENTS 1,327,077 A * 1/1920 Abercrombie et al. ..... 166/181
1,975,390 A * 10/1934 Davis ..... 166/181
3,463,228 A * 8/1969 Hearn ..... 166/181
4,375,240 A 3/1983 Baugh ..... 166/387
4,862,957 A 9/1989 Scranton ..... 166/51
5,690,172 A 11/1997 Westra ..... 166/123

* cited by examiner

*Primary Examiner*—David Bagnell
*Assistant Examiner*—Matthew J Smith
(74) *Attorney, Agent, or Firm*—J. Sanchelima; A. Bordas

(57) ABSTRACT

A packing tool assembly for sealing oil well bores that basically includes an elongated tubular member, two deformable sealing units, two stopper ring members and a cylinder member. A setting tool transports the packing tool assembly and the former stays in the oil well bore during the preparation and sealing phases without requiring the typical time-consuming withdrawal. When the preparation phase has been completed, the packing tool assembly is disengaged from setting tool and the sealing phase starts immediately. The latch members of the setting tool are received within the internal locking channels of the cylinder member. The setting tool is then rotated to cause the cylinder member to advance towards stopper ring members, deforming outwardly the sealing units. The latter are expanded against the walls of oil well bore. Once expanded the sealing units, the setting tool is removed and a tool for the extraction phase is inserted. By expanding the sealing units, the oil is forced to flow through the filter avoiding sand and mud.

4 Claims, 4 Drawing Sheets

PACKING DEVICE FOR OIL WELLS

BACKGROUND OF THE INVENTION

1. Field of the Invention

The present invention relates to a packing device for oil well shafts, and more particularly, to a packing tool assembly that can be used for vertical and horizontal oil wells to seal main conduits during the bore preparation phase.

2. Description of the Related Art

Many designs for sealing oil wells have been designed in the past. None of them, however, include a system for sealing the well bore by compressing rubber cylinder members with the setting tool without retrieving the latter from the oil well bore. This obviates the time consuming task of taking out the setting tool before sealing the bore, which is required by conventional well packers or sealers. In the operation of oil wells, it is common to seal the well bore to prevent the flow of oil outside the conduit (through the space that exists between the conduit and the bore). To this end, after the preparation of the well bore, a setting tool is utilized to prepare the oil well bore and it needs to be withdrawn (a time consuming operation since these bores extend for thousands of meters) so that the sealer or packer apparatus can then be installed. In the present invention this is overcome and the setting tool is not withdrawn to install the packer or sealer assembly. Rather, the sealer assembly is carried by the setting tool and remains on the setting tool during the preparation stage without interfering with this operation. Subsequently, the packer assembly is installed in place.

Applicants believe that one the closest references corresponds to U.S. Pat. No. 4,862,957 issued to Scranton in 1989 for a packer and service tool assembly. This reference also provides a sealing packing tool assembly. However, it differs from the present invention because Scranton's patented assembly provides for the compression of the packer elements to be accomplished with a slips system. This made Scranton's packer complicated and difficult to use, let alone being more expensive. Scranton's invention requires around 3 days for installation and usually the packer is jammed delaying considerably its installation process.

Applicants also believe that another related reference corresponds to U.S. Pat. No. 4,375,240 issued to Baugh et al. in 1983 for a well packer. Baugh et al.'s patented invention also provides a sealing packer operated with a slips system. Baugh et al.'s patented invention is also very difficult to operate. It does not disclose the deformable sealing cylinders included in the present invention.

Finally, Applicant believes that another related reference corresponds to U.S. Pat. No. 5,690,172 issued to Westra in 1997 for a seal-sub packer and a setting tool therefor. Westra's patented sub-packer assembly is formed by a two-mandrel packer and a setting tool, which positions the packer within the casing. However, it differs from the present invention because Westra's sub-packer assembly is designed to work only with Westra's setting tool. With the present invention the packer device can be installed with any standard setting tool.

None of these references, or any other device known to Applicants, provide for a packer assembly that can be lowered with the preparation rig and installed without requiring the retrieval of the rig.

Other patents describing the closest subject matter provide for a number of more or less complicated features that fail to solve the problem in an efficient and economical way. None of these patents suggest the novel features of the present invention.

III. SUMMARY OF THE INVENTION

It is one of the main objects of the present invention to provide a sealing packer assembly for vertical and horizontal bores that can be carried by a setting tool during the preparation operation and can be installed without requiring the withdrawal of the setting tool.

It is another object of this invention to provide such a device that can be used to seal a well bore during the extraction phase forcing the oil to flow through the filter avoiding the extraction of significant amount of sand and mud.

It is still another object of the present invention to provide a sealing packer easy to install and operate.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
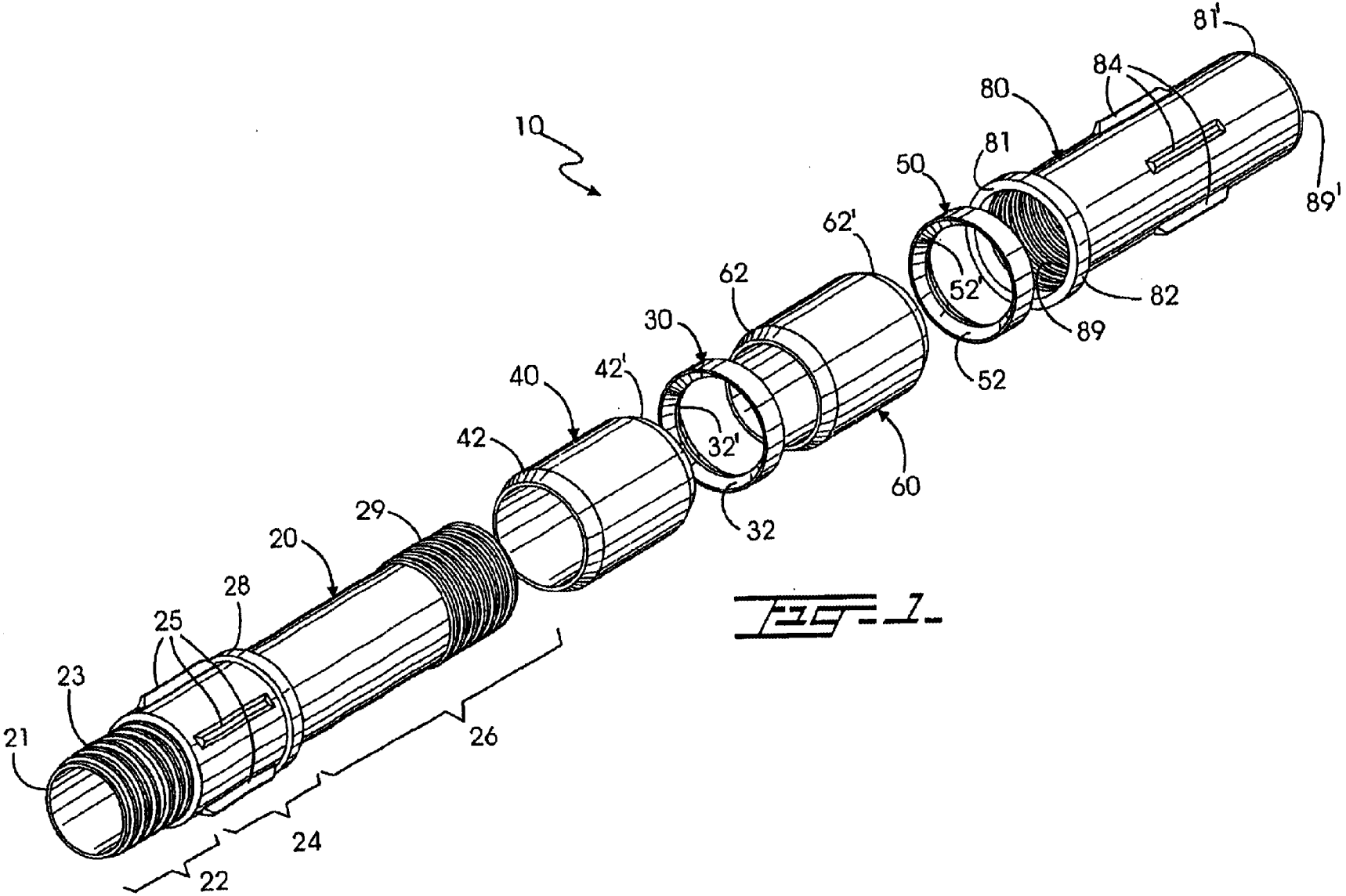
FIG. 1 is an exploded view of the packing tool assembly object of the present invention.

Referring now to the drawings, where the present invention is generally referred to with numeral 10, it can be observed that it basically includes elongated tubular member 20, sealing units 40 and 60, stopper ring members 30 and 50, and cylinder member 80.

Figure 2:
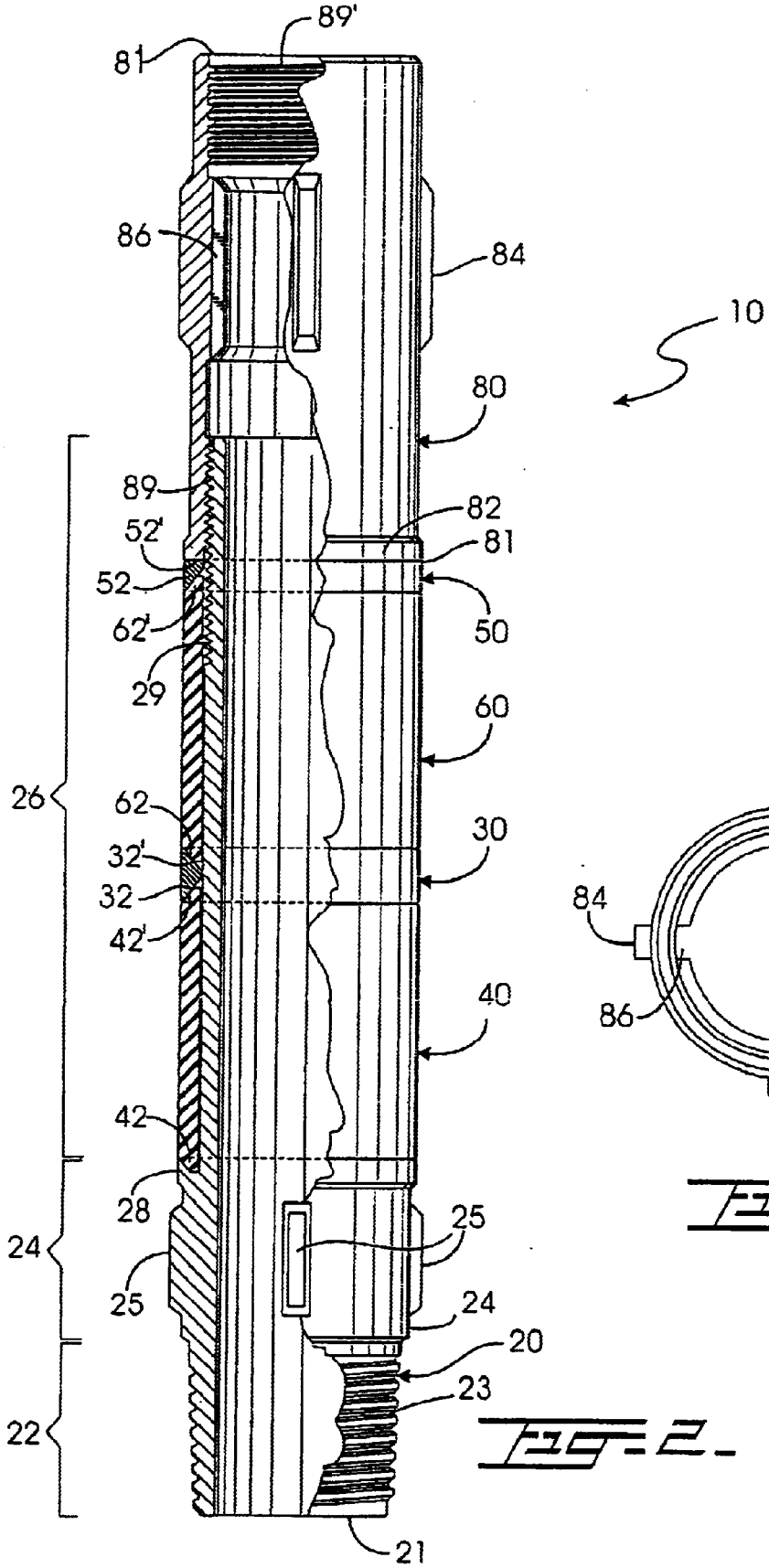
FIG. 2 shows a partial cross sectional view of the packing tool assembly with sealing units, stopper members and cylinder member positioned to be used in an oil well bores.

In FIG. 1, an exploded view of the invention is shown. When the different components are assembled, the resulting assembly is shown in FIG. 2.

As shown in FIG. 1, elongated tubular member 20 has three portions. Front portion 22 is adjacent to the front end 21. Portion 22 includes external thread 23. Central portion 24 includes longitudinally disposed guiding members 25 that extend outwardly a predetermined distance. Guiding members 25 are used to prevent packing tool assembly 10 from contacting bore B. Rear portion 26 has a cylindrical shape and is longer than portions 22 and 24. Portion 26 has cooperative dimensions to permit it to go through sealing units 40 and 60 and stopper ring members 30 and 50. Portion 26 includes slanted stopper end 28 and external thread 29. Slanted stopper end 28 coacts with slanted edge 42 of sealing unit 40 to present a fixed surface. Portion 26, portion 24 and portion 22 constitute, in the preferred embodiment, a unitary piece.

Sealing units 40 and 60 have a substantially cylindrical shape. Sealing units 40 and 60 have cooperative dimensions that permit the insertion of portion 26 therethrough. Sealing units 40 and 60 are made out of a deformable and resistant material such as hard rubber or similar material. Sealing unit 40 includes slanted edges 42 and 42', as best seen in FIG. 2 to cooperate with slanted stopper end 28. This slanted complementary shape enhances the engagement of these elements. Sealing unit 60 includes slanted edges 62 and 62'. Edges 42; 42'; 62 and 62' cooperatively engage slanted stopper end 28 and slanted surfaces 32; 32' and 52, respectively. Sealing units 40 and 60 are selectively deformed to extend radially outwardly to come in sealing contact with the wall of oil well bore B when stopper ring members 30 and 50 are advanced towards slanted stopper end 28. Stopper ring members 30 and 50 have interior diameters that cooperatively permit the insertion of portion 26 therethrough. Stopper ring member 30 includes slanted surfaces 32 and 32'. Slanted surface 32 cooperatively coincides with slanted edge 42' of sealing unit 40. Slanted surface 32' cooperatively coincides with slanted edge 62 of sealing unit 60. Stopper ring member 50 includes slanted surface 52 and flat surface 52'. Slanted surface 52 cooperatively engages slanted edge 62'. Flat surface 52' faces front flat end 81 of cylinder member 80. When internal threaded section 89 engages external thread 29 and cylinder 80 advances, front flat end 81 coacts with flat surface 52' forcing ring member 50 towards stopper end 28.

Figure 3:
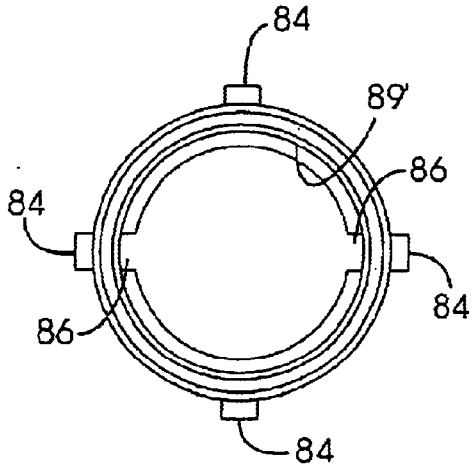
FIG. 3 is a top view of the packing tool assembly showing the latch receiving channels.

Cylinder member 80 has a substantially cylindrical shape. Cylinder member 80 includes front flat end 81, rear end 81', flange 82, guiding member 84, and internal threaded sections 89 and 89', as seen in FIG. 1. As best seen in FIGS. 2 and 3, flange 82 is adjacent to front flat end 81. Flange 82 extends outwardly from the outer wall of cylinder member 80. Guiding members 84 are used to guide member 80 preventing packing tool assembly 10 from coming in direct contact with wall of bore B. Locking channels 86, are formed on the inner wall of cylinder member 80 at a predetermined distance from rear end 81'.

Internal threaded section 89 is next to end 81. The threads of section 89 mate with the threads of end 29. Internal threaded section 89' is next to end 81'.

Setting tool 90 transports packing tool assembly 10. Setting tool 90 basically includes threaded end 92, to which conventional perforation tools (not shown) are mounted with cooperating threads. Latch members 96 and threaded section are usually found in conventional setting tool 90. Latch members 96 are cooperatively received by locking channels 86, as best seen in FIG. 3. Members 96 transmit the rotational movement of setting tool 90 to packing tool assembly 10. Threaded section 99 mates with internal threaded section 89' to transport assembly 10.

Figure 4:
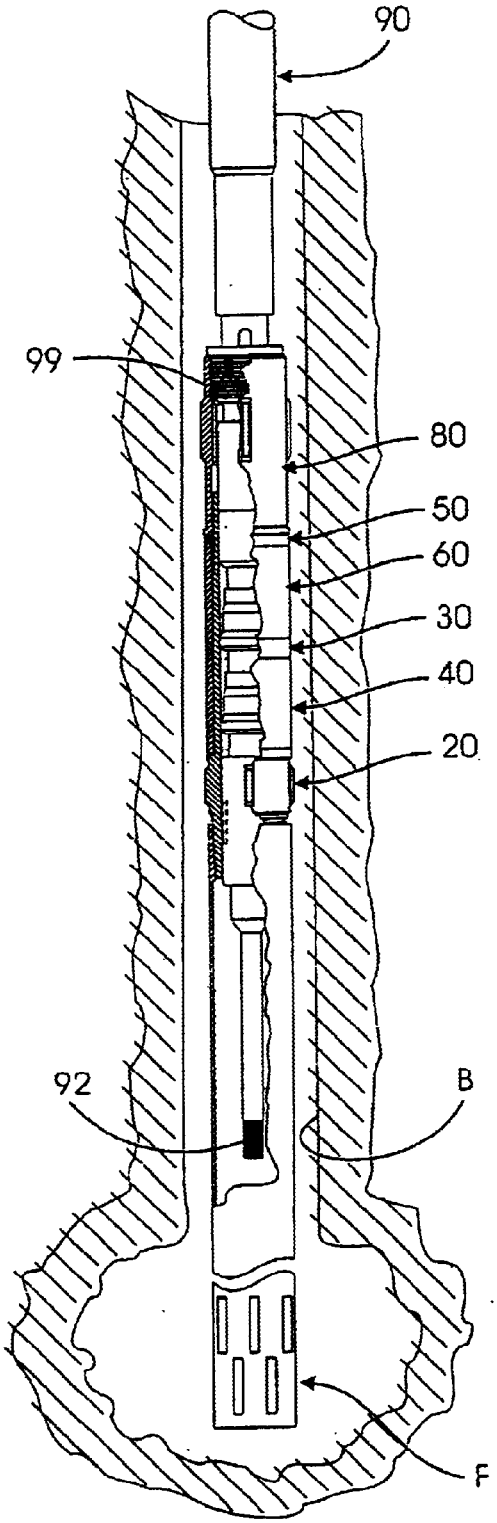
FIG. 4 represents a partial cross sectional view of the packing tool assembly installed to a setting tool and inserted in an oil well during the preparation for the extraction phase.
Figure 5:
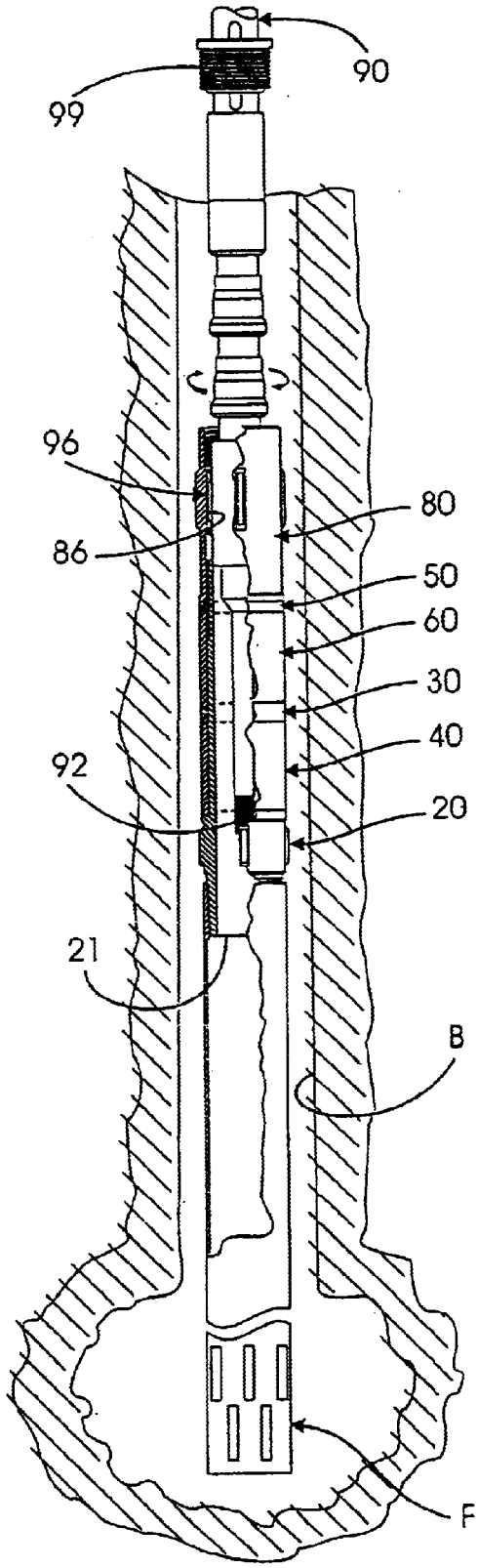
FIG. 5 shows a partial cross sectional view of the packing tool assembly object of the present invention, installed to a setting tool and inserted in an oil well after the preparation phase has finished and the setting tool's latch is inserted in the packing tool's latch receiver channel.
Figure 6:
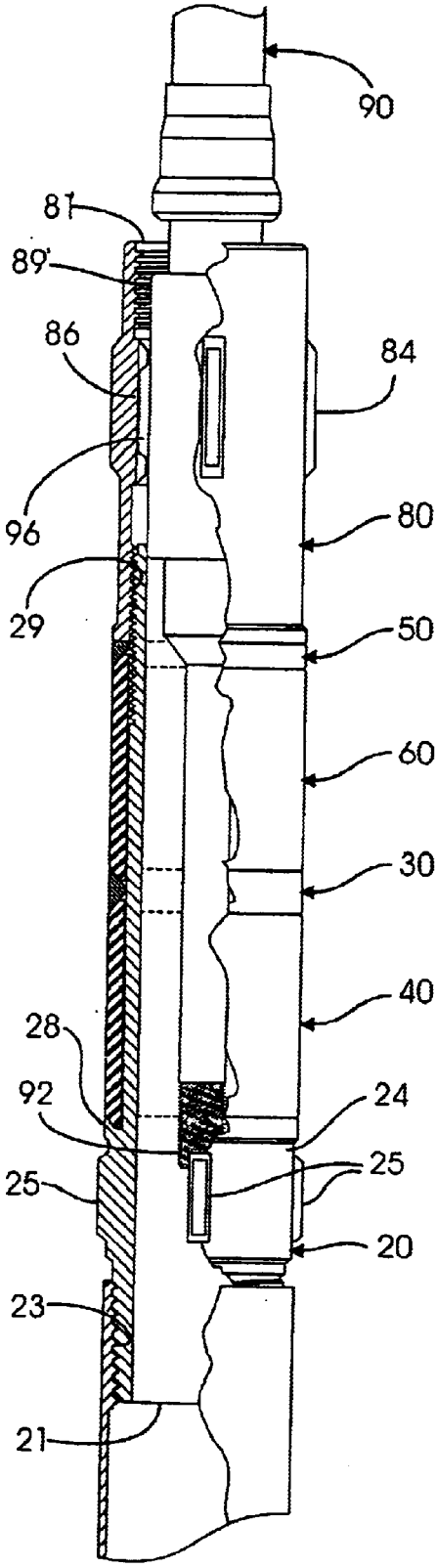
FIG. 6 shows a detailed partial cross sectional view of the packing tool assembly installed to a setting tool when the setting tool's latch is inserted in the packing tool's latch receiver channel as shown in FIG. 5.
Figure 7:
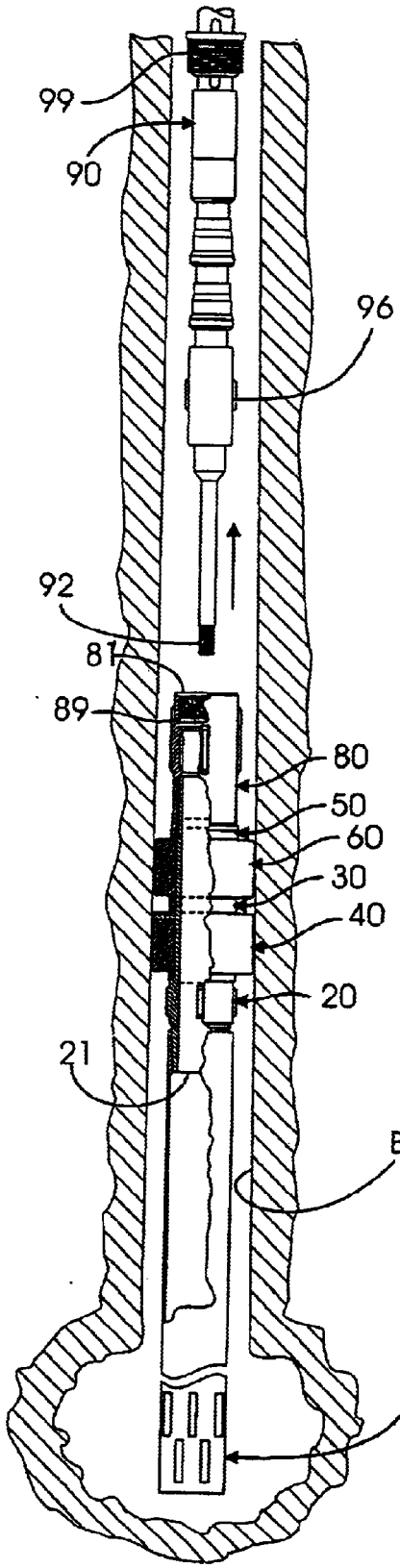
FIG. 7 illustrates a partial cross sectional view of the packing tool assembly and the packing tool assembly has been positioned for the extraction phase and the sealing units are expanded.

As shown in FIG. 4, setting tool 90 transports packing tool assembly 10 and the former stays in oil well bore B during the preparation phase. When preparation phase has been completed, packing tool assembly 10 is disengaged from setting tool 90, as shown in FIG. 5, by unscrewing thread 99 from internal threaded section 89'. Latch members 96 are received within locking channels 86, as best seen in FIG. 6. In FIG. 7, setting tool 90 is rotated to cause cylinder member 80 to advance towards stopper end 28, deforming outwardly sealing units 30 and 50. The latter are expanded against the walls of bore B. Once expanded sealing units 30 and 50, setting tool 90 is removed and a tool for the extraction phase is inserted. By expanding sealing units 30 and 50, the oil is forced to flow through filter F avoiding sand and mud.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A packing tool assembly for sealing oil well bores comprising:

A) setting tool means for transporting and actuating said packing tool assembly, including a distal end;

B) first tubular means having a first and second end; said first end, including means for engaging said distal end to said first end;

C) second tubular means having third and fourth ends, said third end including means for engaging said second end to advance said first and second tubular means telescopically within each other and D) deformable sealing means mounted over said first tubular means, said deformable sealing means being selectively deformed to extend radially outwardly to come in sealing contact with a well bore by the telescopic advance of said first and second tubular means, said sealing means includes a deformable cylindrical member that is kept in place first and third ends said first and said tubular means, respectively so that when said third end is advanced toward said first end, said deformable cylindrical member is forced radially outwardly;

E) elongated tubular filter means having a fifth and sixth ends, said fifth end including means for engagement to said fourth end and sixth end including a filter assembly to prevent the entry of solids of a predetermined size to corning into said tubular filter means.

2. The packing tool assembly set forth in claim 1 wherein said first end includes stopper means providing a fixed point against which said deformable cylindrical members is pushed.

3. The packing tool assembly set forth in claim 2 further including

F) a stopper ring member slidably mounted over said first cylindrical member and having a cooperative surface that coacts with said third end to transmit the movement of said second cylinder.

4. The packing tool assembly set forth in claim 3 wherein said setting tool means includes at least one latching member extending outwardly and said second cylindrical member includes at least one internal locking channel for receiving said latching members so that the rotation of said setting tool is transmitted to said packing tool assembly through said latching member and said locking channel.

* * * * *